US005659145A

United States Patent [19]

Weil

[11] Patent Number: 5,659,145

[45] Date of Patent: Aug. 19, 1997

[54] FOOT OPERATED AUDIO SIGNAL CONTROLLER WITH LIGHTED VISUAL REFERENCE

[76] Inventor: Robert P. Weil, 11 Bedford Ave. #G-2, Norwalk, Conn. 06850

[21] Appl. No.: 429,953

[22] Filed: Apr. 27, 1995

[51] Int. Cl.[6] ..... A63J 17/00

[52] U.S. Cl. ..... 84/464 R; 84/721; 84/746

[58] Field of Search ..... 84/422.1, 464 R, 84/721, 741, 746

[56] References Cited

U.S. PATENT DOCUMENTS

| | | | |
|---|---|---|---|
| 3,045,522 | 7/1962 | Markowitz et al. | 84/464 R |
| 4,386,550 | 6/1983 | Newsome et al. | 84/464 R |
| 4,939,501 | 7/1990 | Weil | 338/153 |
| 5,274,710 | 12/1993 | Shaffer et al. | 84/746 |
| 5,391,830 | 2/1995 | Nishino et al. | 84/626 |

*Primary Examiner*—Cassandra C. Spyrou

[57] ABSTRACT

A foot-operated signal controlling pedal with a series of LED's integrated in the pedal housing to indicate signal level. The pedal may perform one or more of a variety of sound effect functions with any of the common circuits in use currently, with a parallel but separate circuit controlling the LED display. The invention is of the typical rocker pedal design with a linkage joining the foot pedal to variable resistors which control the LED's and the audio signal in a parallel and simultaneous fashion.

1 Claim, 2 Drawing Sheets

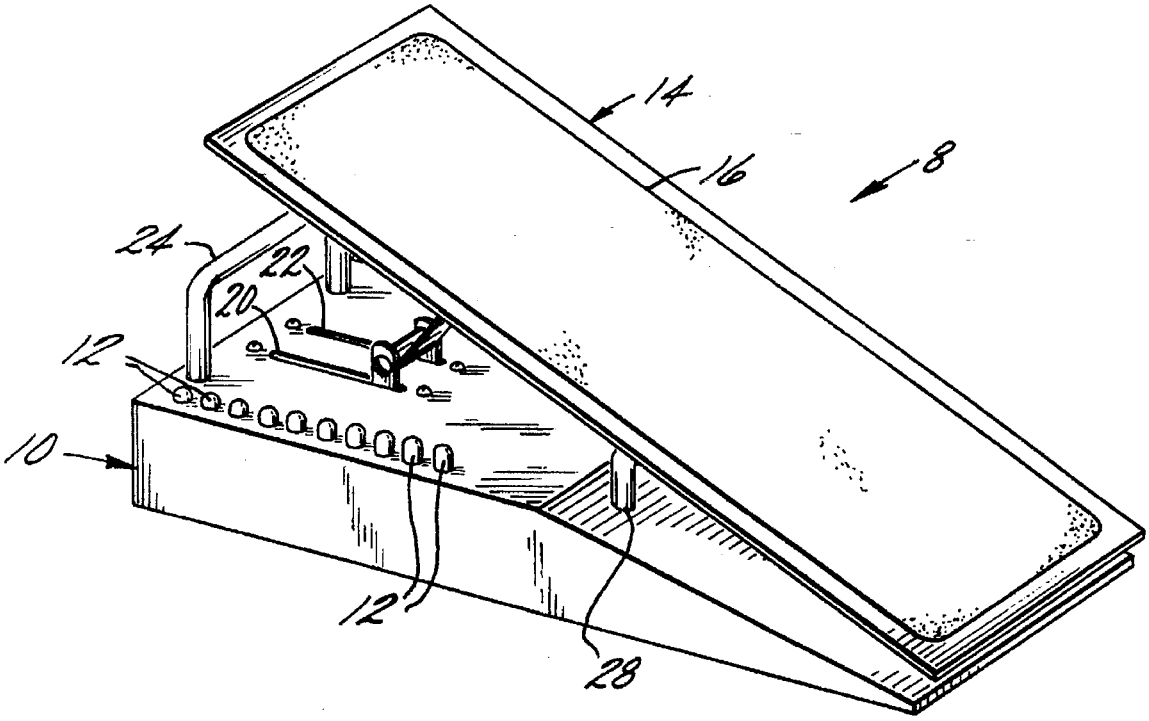

FOOT OPERATED AUDIO SIGNAL CONTROLLER WITH LIGHTED VISUAL REFERENCE

BACKGROUND—FIELD OF INVENTION

This invention relates to musical instrument accessories, specifically to an improved pedal design for musical instrument signal processing.

BACKGROUND—DISCUSSION OF PRIOR ART

Pedals of the "up-down" treadle design, or "rocker" pedals, have been in use by musicians since the early days of electric/electronic amplified music. This common design, reminiscent of an automobile accelerator pedal or an organ pedal, enables a musician to control his instrument's signal in a hands-free manner. In this way, the musician's playing is not interrupted while volume or other sound effect is changed.

While this design is certainly useful on its own merit, it does lack one essential feature found on almost any other control device: a visual reference. No rocker pedals currently or previously on the market or patented have included an integrated visual readout. A slide-action pedal previously patented by myself solved this problem partially, but with a movement unfamiliar to most musicians (see U.S. Pat. No. 4,939,501 to Weil, 1990 Jul. 3, enclosed herewith).

The need for a visual reference is particularly acute when two or more musicians are playing amplified instruments together. When sound levels get high, it becomes difficult to hear subtle changes in volume or effect while on stage. These changes can be heard, however, in the audience where sound is more evenly distributed. Thus, for example, a musician who thinks he has returned to a previously set level with his foot pedal after completing a solo, may actually be playing too loud or too soft for the audience.

A partial solution some foot pedal manufacturers have taken to this last example has been to provide a manually adjustable minimum setting with either electronic or mechanical means. In this way, when the pedal is all the way back, or "heel-down", the signal is at a preset minimum value other than zero. The disadvantage of this approach could be compared to a cruise control device on an automobile where a minimum speed may be set and the accelerator may be used to increase speed, but there is no way to go less than the minimum speed unless the car is turned off. While the consequences of this are not as drastic with a musical instrument as with a car, it is still desirable to have the ability to control one's instrument from zero through the full range of signal.

OBJECTS ADVANTAGES

Accordingly, several objects and advantages of my invention are as follows:

(a) The invention provides a lighted visual reference via an LED display which allows for accurate level control not achievable with previous rocker pedals;

(b) The lighted visual reference allows for level control without the need for a minimum setting which can limit operation of the pedal;

(c) With no minimum setting limiting signal range, a musician may bring the pedal to a "zero" level for noiseless instrument tuning or to diminish the amount of sound effect from the pedal;

(d) The invention provides a novel and attractive visual stage effect for musicians and their audience which has not existed with traditional pedal designs.

Further objects and advantages of my invention will become apparent from a consideration of the drawings and ensuing description.

DRAWING FIGURES

REFERENCE NUMERALS IN DRAWINGS

Figure 1:
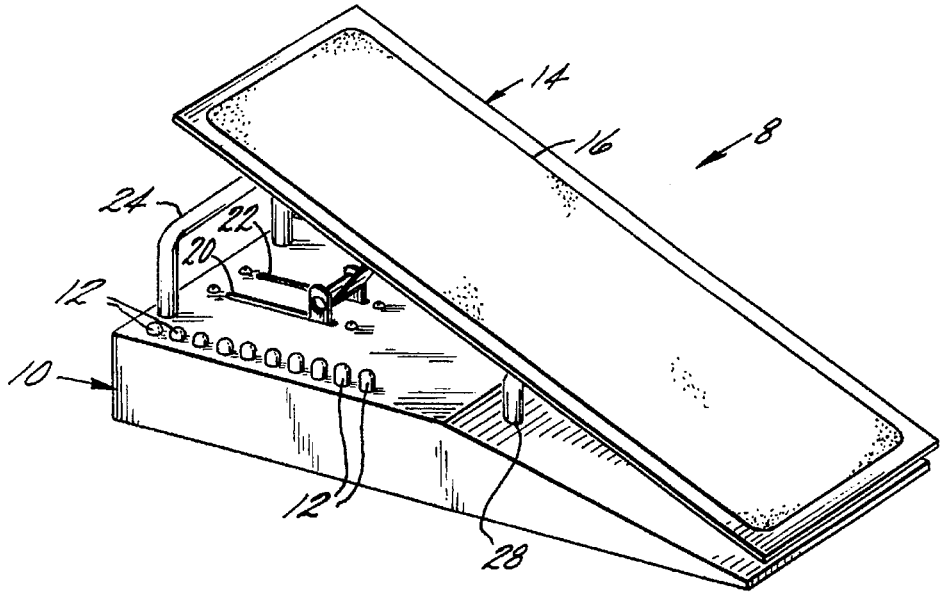
FIG. 1 is a perspective view of my invention.

8 the invention as a whole
10 base housing
12 LED's
14 foot pedal
16 gripping surface
18 foot pedal linkage
20 slot for communicating with variable resistor(s) for LED control
22 slot for communication with variable resistor(s) for audio control
24 end stop bar (front)
26 end stop bumper (rear)
28 support member
30 anti-skid bumpers

DESCRIPTION OF INVENTION

The following detailed description illustrates the invention by way of example and not by way of limitation of the principles of the invention. The example shown may or may not be the best embodiment of the invention, but is merely the first embodiment to be made and tested. Anyone skilled in the art will be able to assemble their own particular design, based on this invention, using materials and circuitry which are already in use today.

Figure 3:
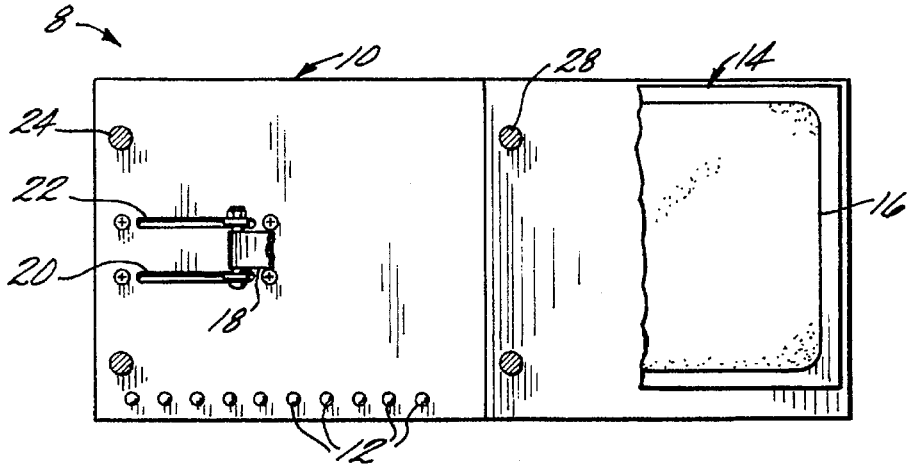
FIG. 3 is a sectional plan view taken along line 3—3 in FIG. 2.
Figure 2:
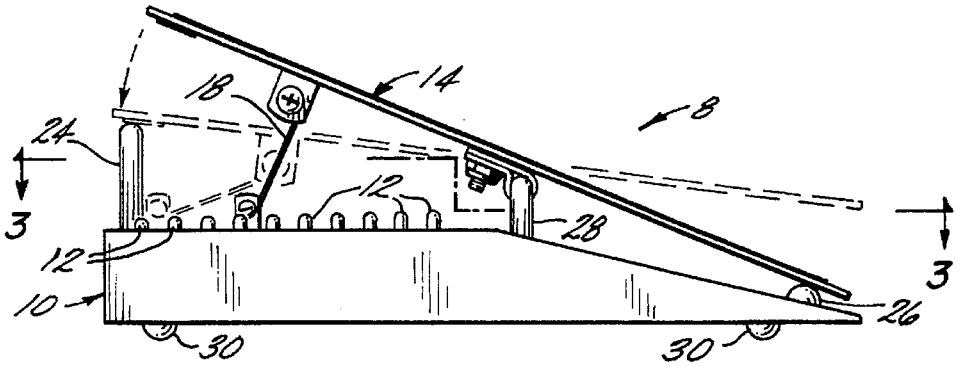
FIG. 2 is a side view showing operating motion.

FIGS. 1, 2, and 3 all show views of the current embodiment of the invention 8. A base housing 10, normally constructed with a top piece and bottom piece, has a series of LED's 12 protruding though the top. The LED's 12 light in sequence as a foot pedal 14 is moved to the "toe-down" position, and go off in sequence as the foot pedal 14 is moved back to the "heel-down" position. A musician's foot is kept from slipping by a gripping surface 16, preferably made from rubber.

An audio circuit and an LED circuit are controlled by a foot pedal linkage 18 which communicates with both the foot pedal 14 and the variable resistors (not shown) via slots 20 and 22 in the base housing 10. The variable resistors are adjusted in a parallel and simultaneous fashion so that the LED's 12 accurately reflect the audio output signal (see also FIG. 4).

End stops 24 and 26 are provided to prevent the foot pedal 14 from traveling either too far forward or backward. A support member 28 is necessary as a pivot point for the foot plate 14. Anti-skid bumpers 30 are affixed to the bottom of the housing 10, one in each corner, to keep the unit from sliding on the floor.

Figure 4:
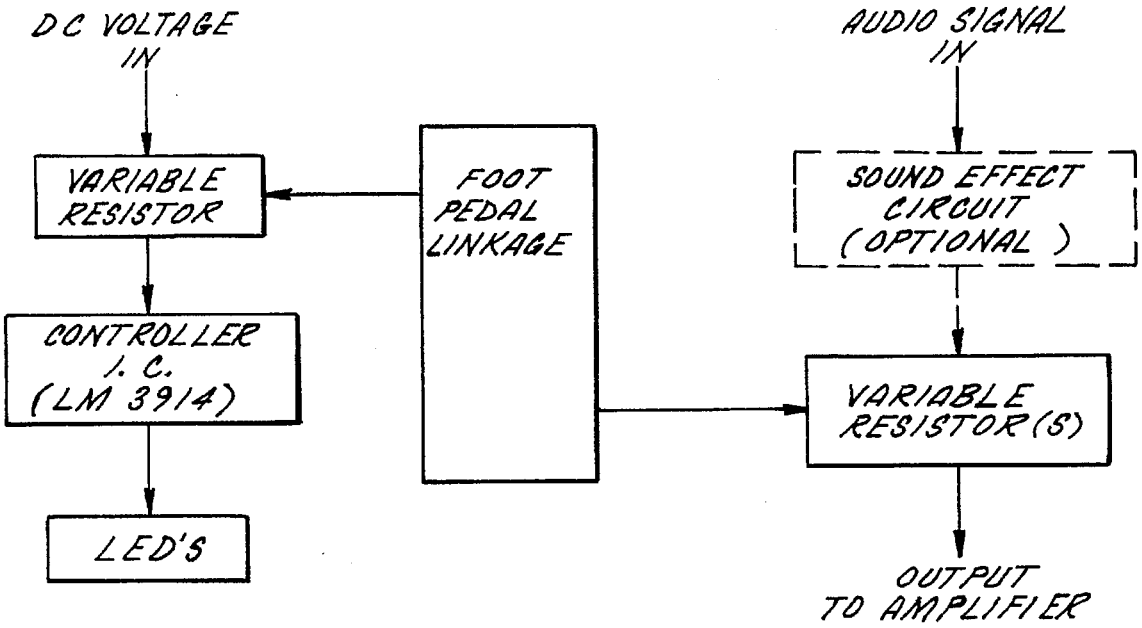
FIG. 4 is a simplified flow chart showing parallel circuits of the invention.

The flow chart in FIG. 4 shows the parallel circuits used in the invention. Five volts of regulated DC voltage pass through a variable resistor and are fed into a controller IC (LM3914 or similar) as zero to five volts DC. This in turn lights or turns off the LED's in either a bar graph or moving dot fashion. At the same time, an audio signal enters the invention via ¼" phone jacks or an XLR type connector and may be processed by an optional sound effects circuit to change the tonal characteristics of the signal. Whether the signal is processed by sound effects or not, it will be varied in strength by a variable resistor or resistors before leaving the unit via ¼" phone jacks or an XLR type connector. As mentioned earlier, the variable resistors for both the LED's and the audio signal are adjusted in a parallel and simultaneous fashion by the foot pedal linkage indicated in the center of FIG. 4.

Conclusion, Ramifications, and Scope

At this point, it should be noted that the specific design of the component parts described in FIGS. 1–3 is not of particular importance since rocker pedals are common and varied in design. The uniqueness of this invention is the addition of LED's to the common design as a lighted visual reference for signal strength. The LED's themselves may be either a series of LED dots as described in the current embodiment, or numeric "seven segment" type displays. Another possible ramification for the visual reference could even be a lighted LCD panel with numeric or graphic display. In addition, the variable resistors mentioned previously can take many forms including, but not limited to: potentiometers (both rotary and slide), photocells (a.k.a. light dependent resistors [LDR's] or photoresistors), optoisolators, electronic attenuators, automatic gain control (AGS) integrated circuits, or any combination of these devices.

The scope of this invention may include, but should not be limited to, the following types of audio signal effect or control pedals: volume, pan, blend, overdrive and/or distortion, chorus, flange, phaser, wah-wah, whammy, pitch-shifting, delay, reverb, or combinations of any two or more of these. In any of these embodiments, the signal and/or effect level can be changed by moving the foot pedal up or down and that change can be clearly and accurately seen in the lighted visual reference. This enables the performing musician to control his sound more precisely than with any previous rocker pedal design.

Thus the scope of the invention should be determined by the appended claims and their legal equivalents, rather than by the examples given.

I claim:

1. A foot operated rocker pedal comprising:

a base housing;

a series of visual indicators on said housing;

a means for selectively actuating said series of visual indicators being positioned within said housing;

an audio circuit;

a foot pedal;

foot pedal linkage means connected to said foot pedal controlling said audio circuit and communicating the movement of said foot pedal to said actuation means such that said actuating means sequentially actuates the series of visual indicators.

* * * * *